United States Patent [19]

Ketchum, Jr.

[11] 4,096,996

[45] Jun. 27, 1978

[54] DIFFUSER FOR FUEL BURNERS

[76] Inventor: Elmer Ketchum, Jr., 4805 Lansing Ave., Jackson, Mich. 49201

[21] Appl. No.: 722,646

[22] Filed: Sep. 13, 1976

[51] Int. Cl.[2] ..... F23D 15/00

[52] U.S. Cl. ..... 239/406; 431/352

[58] Field of Search ..... 239/402, 406; 431/182, 431/185, 351, 352

[56] References Cited

U.S. PATENT DOCUMENTS

| | | | |
|---|---|---|---|
| 2,688,360 | 9/1954 | Haynes et al. | 431/185 X |
| 3,267,984 | 8/1966 | Reed et al. | 431/185 |
| 3,574,508 | 4/1971 | Rothhaar et al. | 431/351 |
| 3,814,575 | 6/1974 | Cox, Jr. et al. | 431/352 |
| 3,881,863 | 5/1975 | Creuz | 431/352 X |

*Primary Examiner*—Joseph F. Peters, Jr.
*Assistant Examiner*—Michael Mar
*Attorney, Agent, or Firm*—Learman & McCulloch

[57] ABSTRACT

A fuel burner diffuser comprises a frustoconical support fitted at its smaller diameter end to a fuel burner nozzle from which fuel is emitted in a conical stream. A plurality of series of gas jets are carried by and spiral about the support for introducing combustion-supporting gas into the fuel stream. The jets are mounted on the support in such manner that gas passing through the jets is substantially perpendicular to the longitudinal axis of the fuel stream so as to facilitate penetration of the fuel stream by the gas. Those jets which are substantially diametrically opposed to one another are circumferentially offset so as to avoid diametrical confrontation for the purpose of promoting better mixing of the fuel and gas. The cross sectional areas of the jets increase in a direction away from the fuel burner to enable a greater quantity of gas to be supplied to the fuel as the cross sectional area of the fuel stream increases.

21 Claims, 2 Drawing Figures

DIFFUSER FOR FUEL BURNERS

In the operation of fuel fired boilers and the like it is conventional to discharge fuel through a fuel atomizer in proximity to an igniter by means of which the fuel initially is ignited. The fuel conventionally is discharged from the atomizer under pressure in a conical stream. To improve the combustion of the fuel it is conventional to encircle the fuel stream with a conical diffuser having a plurality of combustion-supporting gas passages arranged to introduce gas into the diffuser. Most of the known diffusers mount the gas passages in such manner as to cause the gas streams to impinge more or less tangentially on the fuel stream for the purpose of imparting a swirling movement to the fuel stream so as to promote mixing of the fuel and the gas. Quite often, however, the velocity and density of the fuel stream are such that the gas is unable to penetrate the stream as a consequence of which fuel at the core of the fuel stream is not burned at or at about the same time that the fuel at the outer part of the fuel stream is burned. The combustion of the fuel this occurs progressively, resulting in a relatively long flame having a temperature lower than that which would be the case if the fuel were combusted more quickly.

A diffuser constructed in accordance with the invention has characteristics similar to conventional diffusers, but differs from the latter in several significant aspects. For example, the combustion supporting gas jets are mounted on the diffuser in such manner as to assure penetration of the fuel stream by the gas, thereby accelerating combustion of fuel components inwardly of the outer confines of the fuel stream. Further, the gas jets are mounted on the diffuser in such manner as to promote mixing of the gas and the fuel inwardly of the confines of the fuel stream, thereby further accelerating combustion of the fuel. In addition, the gas jets are not of uniform cross sectional area, but instead, increase in cross sectional area in the direction of flow of the fuel stream so as to assure an adequate volume of gas as the cross sectional area of the fuel stream increases.

An object of the invention is to provide a diffuser for a fuel burner and which functions to accelerate the combustion of fuel emitted from a fuel atomizer.

Another object of the invention is to provide a diffuser of the character described which results in more efficient combustion of fuel and, consequently, a quicker release of heat from a given quality of fuel than otherwise can be obtained.

Figure 1:
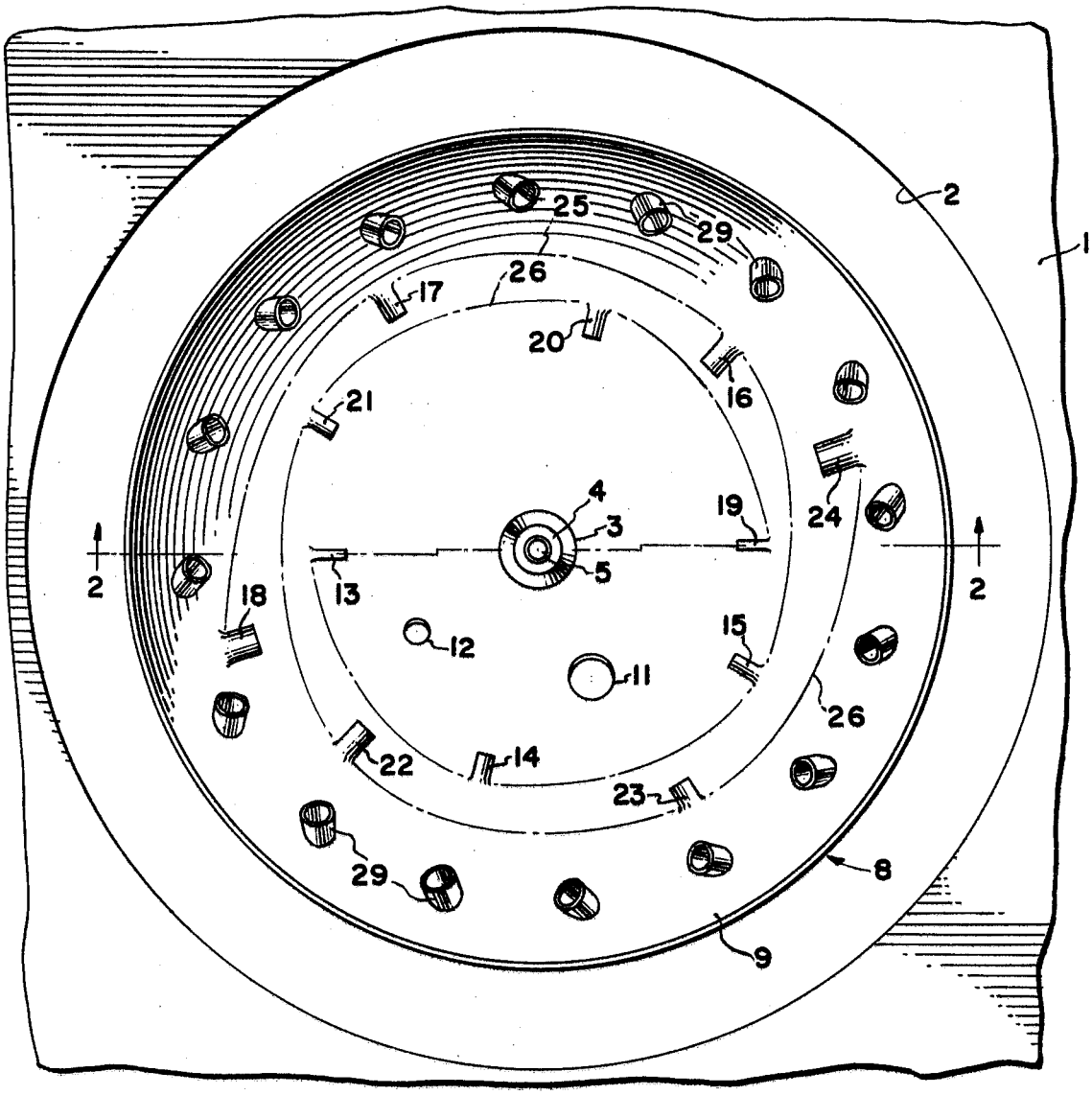
Figure 2:
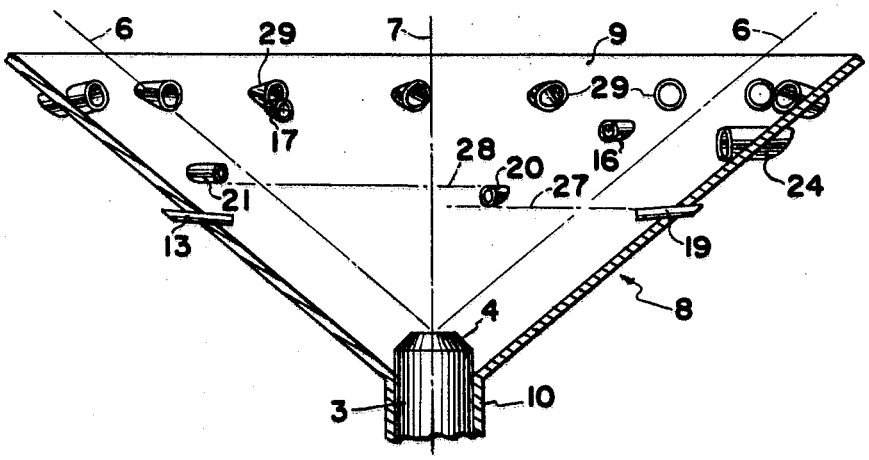

Other objects and advantages of the invention will be pointed out specifically or will become apparent from the following description when it is considered in conjunction with the appended claims and the accompanying drawings, wherein:

FIG. 1 is a front elevational view of a diffuser constructed in accordance with the invention and incorporated in a typical burner installation; and FIG. 2 is a sectional view taken on the line 2—2 of FIG. 1.

Apparatus constructed in accordance with the invention is adapted for use with a furnace or boiler having a wall 1 provided with an opening 2 through which combustion-supporting air may enter the furnace. Concentrically mounted within the opening 2 is a fuel tube 3 terminating in an atomizer 4 having one or more passages 5 from which fuel is emitted under pressure. Preferably, fuel emitted from the atomizer 4 forms a substantially conical stream 6 having a longitudinal axis 7 that is coincident with the longitudinal axis of the fuel tube 3. The fuel stream 6 typically defines a cone of 90° - 110°.

A diffuser constructed according to the invention is designated generally by the reference character 8 and comprises a frustoconical support 9 which diverges in the direction of movement of the fuel stream 6 and at an angle corresponding substantially to that of the fuel stream. At its smaller diameter end the support 9 is joined to an annular sleeve 10 which is fitted on and encircles the fuel tube 3 so that the cones defined by the support 9 and the fuel stream 6 are substantially coaxial. The support 9 may be provided with an opening 11 adjacent the smaller diameter end for the accommodation of a fuel ignitor (not shown) and the support also may be provided with one or more additional openings 12 for the accommodation of scanners (not shown).

The support 9 mounts a plurality of series of tubular jets by means of which combustion-supporting air or gas may be introduced into the interior of the diffuser. In the disclosed embodiment there are two series of jets, those of the first series being designated by the reference characters 13, 14, 15, 16, 17, and 18, and those of the second series being designated by the reference characters 19, 20, 21, 22, 23, and 24. The jets of each series are spaced uniformly both circumferentially and longitudinally of the support 9 so that the jets of each series spiral about the longitudinal axis of the support and form a helix. The helix of the first series of jets is designated by the reference character 25 and the helix of the second set of jets is designated by the reference character 26. The pitch of the helices 25 and 26 will be referred to subsequently.

In the disclosed embodiment there are six jets in each series and the circumferential or angular spacing between each jet of a series toward the larger diameter and of the support is uniform. In the disclosed embodiment, the circumferential spacing between adjacent jets of a series is 75°.

The innermost jets 13 and 19 of each series of jets preferably are located at the same axial distance from the fuel atomizer 4 and on opposite sides of the longitudinal axis of the latter. As is best shown in FIG. 1, however, the jets 13 and 19 are not diametrically opposed from one another. Instead, the jets are angularly offset from the horizontal diametral plane by an amount corresponding substantially to the radius of each jet. The angular off-setting of the first jets of each series, coupled with the uniform spacing between jets of each series, results in all of the other jets of the series being similarly offset from one another, thereby avoiding direct opposition of gas issuing from generally opposed jets for a purpose subsequently to be explained.

Not all of the jets of each series are of uniform cross sectional area. Instead, the diameter or cross sectional area of the jets of each series increases in a direction toward the larger diameter end of the support 9. The cross sectional areas of the jets, and the differences between them, depend upon the diameter of the diffuser, its axial length, the diameter of the fuel stream, and the velocity of the latter. In a typical diffuser having a 100° support cone and an axial length of 15 inches, the jets 13 and 19 are formed from ⅛ inch standard size pipe, the jets 14, 15, and 20, and 21 are formed from ¼ inch standard size pipe, the jets 16, 17, 22, and 23 are formed from ⅜ inch standard size pipe, and the jets 18 and 24 are formed from ½ inch standard size pipe. The sizes of jets employed may be determined empirically taking into account all of the factors referred to earlier.

An important characteristic of the invention is that each jet of each series of jets has its longitudinal axis extending along a line which is substantially radial with respect to the longitudinal axis 7 of the diffuser, rather than tangential or chordal. The longitudinal axes of all of the jets may lie in diametral planes of the support 9 and perpendicular to the plane of the axis 7, but it is preferred that at least the jets 13 and 19 nearest the smaller diameter end of the support be inclined to the diametral plane in a direction toward the atomizer 4 at an angle of between 5° and 10° so as to form with the axis 7 an included angle greater than 90°. The jets 14 and 20 similarly may be inclined if desired. The purpose of the inclination of the jets will be explained hereinafter.

In FIG. 2 there is shown at 27 a portion of a diametral plane which is contiguous to the point of emergence of the jet 19 into the interior of the diffuser 8. There also is shown at 28 a portion of a diametral plane that is contiguous to the point of emergence of the jet 20 into the diffuser. The axial distance between the planes 27 and 28 corresponds to the outside diameter of the jet 20, and it will be noted that the plane 28 is contiguous to the point of emergence of the jet 21 into the diffuser 8. The axial distance between the jets of each series of the latter is similar. As a consequence, the helix defined by the spiraling jets of each series corresponds to the diameters of the jets themselves.

In the disclosed embodiment those ends of the jets which are located externally of the support 9 are beveled along a line generally parallel to the external surface of the support. Some of the air passing through the opening 2 thus may be intercepted by the jets and discharged through the latter into the interior of the diffuser.

Although it is not essential, a circular series of jets 29 may be spaced uniformly about the support 9 adjacent its larger diameter end, such jets being inclined to the diametral plane of the support by about 10° in the direction of movement of flow of fuel. In addition, the longitudinal axes of the jets 29 are inclined laterally of the plane of the support 9 so that the longitudinal axis of each jet 29 extends along a line which is chordal to the fuel cone 6. The size of each jet 29 preferably corresponds to the size of the axially outermost jets 18 and 24 and the ends of the jets 29 which are located externally of the diffuser are similarly beveled.

When the apparatus is conditioned for operation, fuel will be emitted from the atomizer 4 in a conical stream 6 and will be ignited shortly after it is discharged from the atomizer 4 by the igniting means. Air will be supplied to the furnace via the opening 2 and some of the air will be intercepted by the several jets and discharged into the interior of the diffuser 8. As will be apparent from FIG. 2, air is discharged from the jets of each series 25 and 26 thereof in a direction partly in opposition to the flow of the fuel stream and will impinge upon the fuel stream 6 at an acute angle with respect to the cone formed by the fuel stream, thereby facilitating penetration of the fuel stream by the air. As the air penetrates the fuel stream, it will mix with the fuel so as to support combustion of those components of the fuel which lie inwardly of the confines of the stream. The angular offset of generally opposing jets will generate turbulence and agitation of the fuel components inwardly of the periphery of the fuel stream, thereby providing excellent mixing of the fuel and the air so as to provide for relatively fast combustion of the fuel in a relatively short axial distance.

It is contemplated that the air inlet ends of the several jets disclosed may be enlarged to provide for greater air flow through the jets. It also is contemplated that air may be supplied to the jets directly by piping, rather than relying upon interception of the air by the jets.

Although the disclosed embodiment is one in which only a portion of the gas passing through the opening 2 is diverted to the interior of the diffuser, it is contemplated that the diffuser may be of such size and be equipped with a sufficient number of gas jets to cause all of the gas to enter the diffuser.

The disclosed embodiment is representative of a presently preferred form of the invention, but is intended to be illustrative rather than definitive thereof. The invention is defined in the claims.

I claim:

1. A diffuser construction for a fuel burner through which fuel is emitted in a conical stream, said construction comprising a generally conical wall forming a support having a central opening at its longitudinal axis through which said fuel stream may pass, said support diverging in the direction of flow of said fuel stream; and at least one series of a plurality of jets supported by and extending through said wall and through each of which a combustion-supporting gas may pass into said support, said jets spiraling about said support from its smaller diameter end toward its larger diameter end, each of said jets having a longitudinal axis extending along a line which substantially intersects the longitudinal axis of said support, and each of said jets having an inclination to said support such that the longitudinal axis of each of said jets forms with said wall an acute angle.

2. The construction according to claim 1 wherein the angle formed between said wall and the longitudinal axes of those jets adjacent the smaller diameter end of said support is more acute than the angle formed between said wall and the longitudinal axes of those jets adjacent the larger diameter end of said support.

3. The construction according to claim 1 wherein the longitudinal axes of the jets adjacent the smaller diameter end of said support are inclined to a diametral plane passing through the longitudinal axis of said support and in a direction toward the smaller diameter end of said support.

4. The construction according to claim 1 wherein the longitudinal axes of jets adjacent the larger diameter end of said support are substantially perpendicular to a plane passing through the longitudinal axis of said support.

5. The construction according to claim 1 wherein jets adjacent said smaller diameter end of said support have a cross-sectional area different from that of jets adjacent the larger diameter end of said support.

6. The construction according to claim 1 wherein said jets are grouped in a plurality of series thereof, the jets of each series being arranged on a helix.

7. The construction according to claim 6 wherein the circumferential spacing between the jets in each series thereof is uniform.

8. The construction according to claim 6 wherein the circumferential spacing between the jets in each series thereof is uniform.

9. The construction according to claim 6 wherein the helix defined by each series of jets commences at the same distance from the smaller diameter end of said support.

10. The construction according to claim 6 wherein the helix defined by each series of jets commences at the same distance from the smaller diameter end of said support.

11. The construction according to claim 10 wherein the helix defined by each series of jets is uniform.

12. The construction according to claim 8 wherein the helix defined by each series of jets is uniform.

13. The construction according to claim 9 wherein corresponding jets of each series thereof are circumferentially offset from one another by an amount such that no jet of any one series is diametrically opposite the corresponding jet of any other series.

14. The construction according to claim 10 wherein the amount of said offset is at least as great as the radius of the corresponding jets.

15. The construction according to claim 12 wherein corresponding jets of each series thereof are circumferentially offset from one another by an amount such that no jet of any one series is diametrically opposite the corresponding jet of any other series.

16. A diffuser for fuel burners comprising a frustoconical wall forming a support having a longitudinal axis and smaller and larger diameter ends, said support having an opening at its smaller diameter end for the accommodation of a fuel burner having a longitudinal axis coinciding with said axis of said support, a plurality of series of jets extending through said wall for introducing combustion-supporting gas into the interior of said support, each series of said jets including a plurality of the latter arranged helically about the longitudinal axis of said support, each of said jets having a longitudinal axis extending along a line substantially radial of said longitudinal axis of said support and forming with said wall an acute angle.

17. A diffuser according to claim 16 wherein the longitudinal axes of selected ones of said jets nearer the smaller diameter end of said support extend along lines which substantially intersect the longitudinal axis of said support and are inclined toward the smaller end of said support to form with the longitudinal axis of said support an included angle greater than 90°.

18. A diffuser according to claim 16 wherein the longitudinal axes of selected ones of said jets extend along lines substantially intersect the longitudinal axis of said support and form with the latter an included angle of substantially 90°.

19. A diffuser according to claim 16 wherein the cross sectional areas of the jets of each of said series increases in a direction toward the larger diameter end of said support.

20. A diffuser according to claim 16 including a circular series of circumferentially spaced jets adjacent the larger diameter end of said support.

21. A diffuser according to claim 20 wherein each jet of said circular series has a longitudinal axis that is chordal of said support and is inclined toward the larger diameter end thereof.

* * * * *

UNITED STATES PATENT OFFICE

CERTIFICATE OF CORRECTION

Patent No. 4,096,996 Dated June 27, 1978

Inventor(s) Elmer Ketchum, Jr.

It is certified that error appears in the above-identified patent and that said Letters Patent are hereby corrected as shown below:

Claim 18, line 3, after "lines" insert -- which --.

Signed and Sealed this

*Ninth* Day of *January 1979*

[SEAL]

*Attest:*

RUTH C. MASON
*Attesting Officer*

DONALD W. BANNER
*Commissioner of Patents and Trademarks*